US005152491A

United States Patent [19]

Forster et al.

[11] Patent Number: 5,152,491

[45] Date of Patent: Oct. 6, 1992

[54] READING MATERIAL SUPPORT

[76] Inventors: Donald R. Forster, 1823 S. Pontiac Way, Denver, Colo. 80224; DeForest R. Chase, 341 Cuchara St., Denver, Colo. 80221

[21] Appl. No.: 567,717

[22] Filed: Aug. 15, 1990

[51] Int. Cl.[5] ..... A47B 19/00

[52] U.S. Cl. ..... 248/454; 248/460

[58] Field of Search ..... 248/454, 463, 456, 441.1, 248/460, 242, 200.1, 231.2

[56] References Cited

U.S. PATENT DOCUMENTS

| | | | |
|---|---|---|---|
| 833,557 | 10/1906 | Snyder et al. | 248/200.1 X |
| 1,371,256 | 3/1921 | Michaelson | 248/242 X |
| 1,507,384 | 9/1924 | Knowlton | 248/454 X |
| 1,876,172 | 9/1932 | Reiddy | 248/242 X |
| 2,006,580 | 7/1935 | Brown | 248/454 |
| 2,949,272 | 8/1960 | Walls | 248/231.2 |
| 4,397,244 | 8/1983 | Rutsche et al. | 248/242 X |

FOREIGN PATENT DOCUMENTS

| | | | |
|---|---|---|---|
| 807351 | 6/1951 | Fed. Rep. of Germany | 248/460 |

*Primary Examiner*—Alvin C. Chin-Shue
*Attorney, Agent, or Firm*—Richard W. Hanes

[57] ABSTRACT

A stand for reading material or sheet material comprising a back support, and a pair of side supports hinged to said back support. A reading material support member is provided between said first and second side supports. First means comprising pins are provided on said support member for attaching said rear end of said support member to said first and second side supports. Second means are also provided on said support member for attaching said front end of said support member to said first and second side supports, said second means comprising pins mounted on a movable bar. A track is provided to guide the pins mounted on the movable bar so that the distance between the pins of said first means and the pins of said second means can be varied to change the angular orientation of the support member with respect to the back support. The reading material support can also be removed so that the stand can be collapsed.

14 Claims, 2 Drawing Sheets

READING MATERIAL SUPPORT

BACKGROUND OF THE INVENTION

The instant invention relates to the field of music stands and lecterns, and particularly those that can be collapsed for movement. Frequently, it is necessary for orchestras, bands, other musical groups, an speaking groups to set up and dismantle their performance equipment. A collapsible music stand is a necessity in such a situation. In the case of stage bands, it is also desireable that the collapsible stand be uniform in height, as viewed by the audience, and yet adjustable to accommodate the proper playing position for various instruments as well as the condition of the user's eyes.

Music stands are also used by musicians to support their reading material during practice sessions. Frequently, musicians practice in groups, thus a collapsible music stand that can be easily moved is desirable. Such a stand can also be used in various rooms of a house, and then quickly dismantled at the end of a practice or performance so that the room can be restored for its original function.

Traditionally, music stands have included the classic metal stand with tripod-type legs. The height of such a stand can be adjusted by lengthening the main support rod. The stand can be dismantled for carrying by collapsing the legs along the rod. Such stands are historically unstable. It is also difficult for the musician to comfortably place himself and his instrument around the stand because of the floor space required by the tripod-type legs. Also the music support of such a stand cannot be adjusted for different viewing angles or cannot support a large volume of music. In the case of stage bands, typical well-known stands are too low for the brass instruments and require such musicians to stand while performing.

Adjustable and collapsible stands for reading material are well known in the reading stand and lectern arts. U.S. Pat. No. 4,119,289 to Kanocz shows one such collapsible stand. The assembly of Kanocz, however, requires the use of pivot pins to achieve the collapsible feature. The removal of such pivot pins can be time-consuming. Also, the angle of the book supporting member cannot be changed easily and quickly.

U.S. Pat. No. 2,006,580 to Broun discloses a portable reading desk. To dismantle the desk it is again necessary to remove securing rods and nuts. This can be time-consuming and, in the case of a musician, difficult to achieve in the middle of a performance.

A portable lectern is shown in U.S. Pat. No. 4,618,120 to Wattles. Again, dismantling and assembling the lectern would be time-consuming. Also, no provision is made for adjusting the angle of the top surface of the lectern.

A collapsible display device which can be used to display open books is shown in the U.S. Pat. No. 2,676,777 to Moushon. Elastic bands are used to achieve the collapsible feature of the display device. The shape of the side members or triangular members of the device determine the angle of inclination of the book support face. Thus, once constructed, the reference device does not provide for changing the angle of inclination of the support face.

SUMMARY OF THE INVENTION

It is an object of the instant invention to provide a music stand or reading material stand which can be collapsed easily and quickly for transporting.

It is a further object of the invention to provide a music stand or support for reading material which can be placed comfortably close to the chair of the user and which can accommodate various types of seating arrangements.

It is another object of the invention to provide a music stand or support for reading material which has a support surface that can be angularly adjusted with respect to the user, and wherein such adjustment can be easily achieved without the use of special tools and can be effected while one hand of the user is otherwise occupied.

The invention comprises a stand for reading material that can be angularly adjusted as well as folded for movement. The stand comprises a back support, two side supports, and a reading material support member located between said side supports. The support member has first pairs of pins near its rear end which cooperate with selected slots on the rear end of each said side supports. The height of the reading material support member is determined by the slots selected.

Slots are also provided in the front ends of the side supports. The reading material support member has a moveable bar mounted thereon. A second pair of pins is mounted on the bar. A track guides the movement of the second pair of pins so that the distance between the first and second pairs of pins can vary. The pins are inserted in the selected slots in the front end of the support member by moving the bar against a bias. The slots are selected based on the desired angular orientation of the reading material support member. The biasing means holds the pins in the selected slot.

The moveable bar also aids in collapsing the stand. The bar is moved against the biasing means to release the second pair of pins from their respective slots. The first pair of pins can then be removed from their respective slots and thus the support member is removed from between the side supports. The stand can then be collapsed. A biasing means biases the two side supports together and encourages them to pivot on hinges with respect to the back support. The side supports then pivot to lay in an overlapped relationship on top of the back support.

The invention also contemplates a music stand for ensembles, bands, orchestra or stage bands, which is uniform in height, as viewed by the audience, but can be adjusted so that the person using the stand can have the music or reading material at a distance suitable to the focal length of the person's glasses or the condition of the person's eyes in relation to the proper playing position of the instrument, and yet be easily collapsed and portable.

When used by stage bands, the saxophone and trombone players can be seated while the trumpet players stand and all music stands will be at the same height when viewed by the audience.

DETAILED DESCRIPTION OF THE INVENTION

Figure 1:
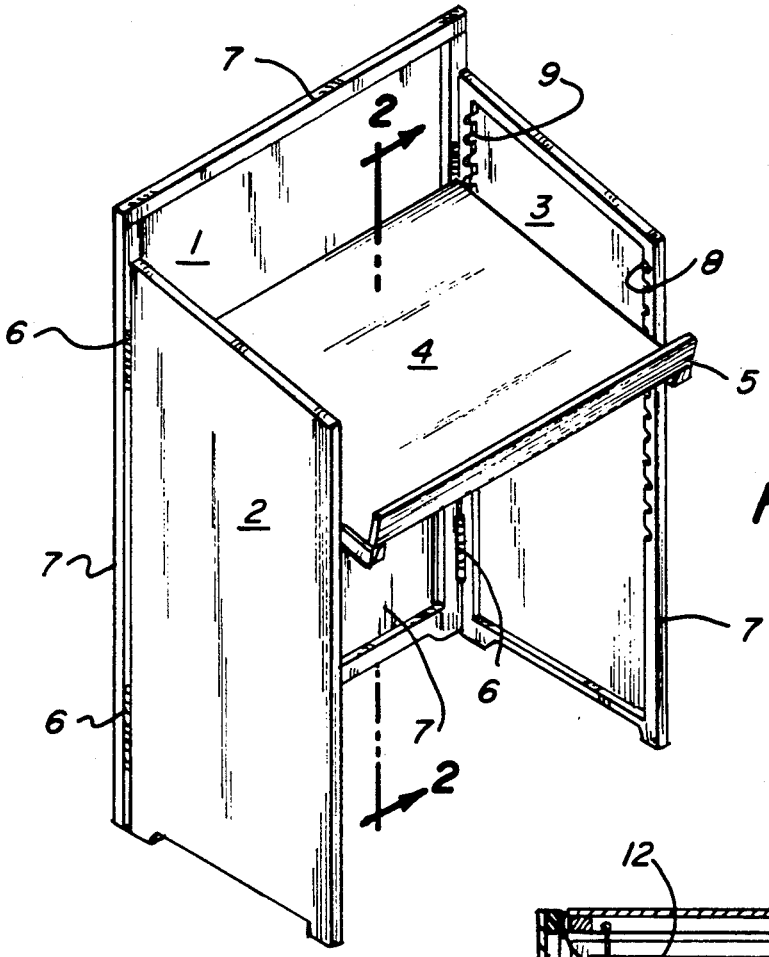
FIG. 1 is a perspective view of the music stand of the instant invention.

FIG. 1 shows an adjustable and collapsible stand used to support reading material or sheet music. The stand comprises a back support 1, two side supports 2 and 3 and a reading material support member or platform 4. A stop member 5 is provided for the reading material support member adjacent its front end to aid in holding the selected reading in place. Hinges 6 are provided for pivotally attaching each of the side supports to the back support. The back support 1 is designated such based on the perspective of the reader although it is understood in a stage band, for example, such a support would be the front as viewed by the audience.

The back, sides, and reading material support member are preferably made from any well known composition wood such as plywood or particle board. Other materials, however, such as various types of rigid plastic, corrugated cardboard, or aluminum could also be used. Dimensioned lumber is used for framing and trim such as shown at 7. Hinges 6 are attached to the dimensioned lumber framing.

Figure 2:
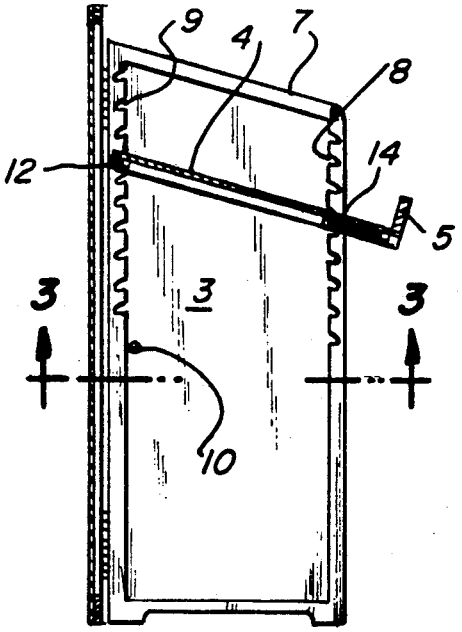
FIG. 2 is a side cross-sectional view taken along line 2—2 of FIG. 1 showing the support tray, back, and one slotted side panel.

Rows of slots 8 and 9 are cut into the framing of the side supports as shown in FIG. 2. The slots 9 are cut into the framing adjacent the back end of each side support near the back support. Slots 8 are cut into the framing adjacent the front end of each side support. The openings for the slots 8 face the openings of the slots 9. Pins 11 and 12, carried by the support member adjacent its rear end, cooperate and fit into slots 9. Pins 13 and 14 are mounted on bar 15 on support member 4. Biasing springs 16 and 17 are attached to bar 15 and support member 4 by means of eye hooks or any other well known attachment means. Well known elastic bands could also be used in place of the biasing springs.

Figure 3:
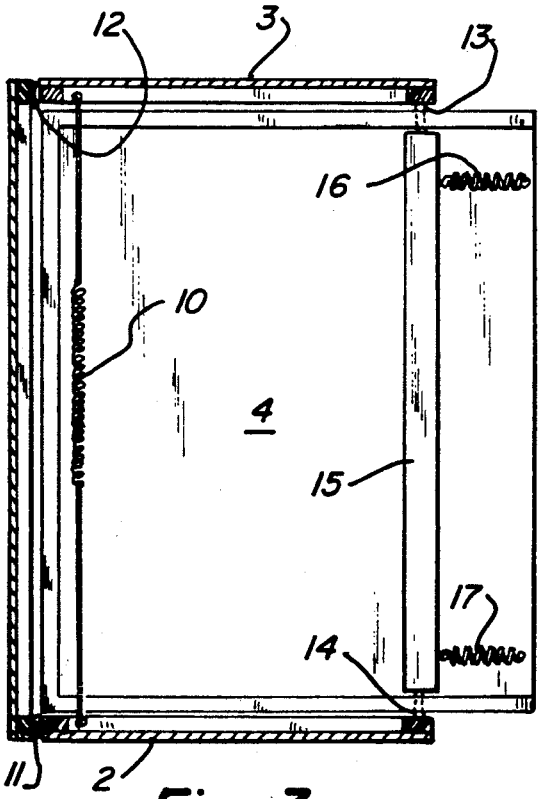
FIG. 3 is a cross-sectional view taken along line 3—3 of FIG. 2 looking up at the underside of the support tray.

An additional biasing spring 10 is attached by similar eye hooks or other well known means to side support 2 and side support 3 as shown in FIG. 3. Biasing spring 10 biases sides 2 and 3 together. Support member 4 provides the opposing force which acts against the bias. The importance of this feature will be apparent later when the collapsing feature of the stand is descirbed. Again, a well known elastic band could be used instead of biasing spring 10.

Figure 4:
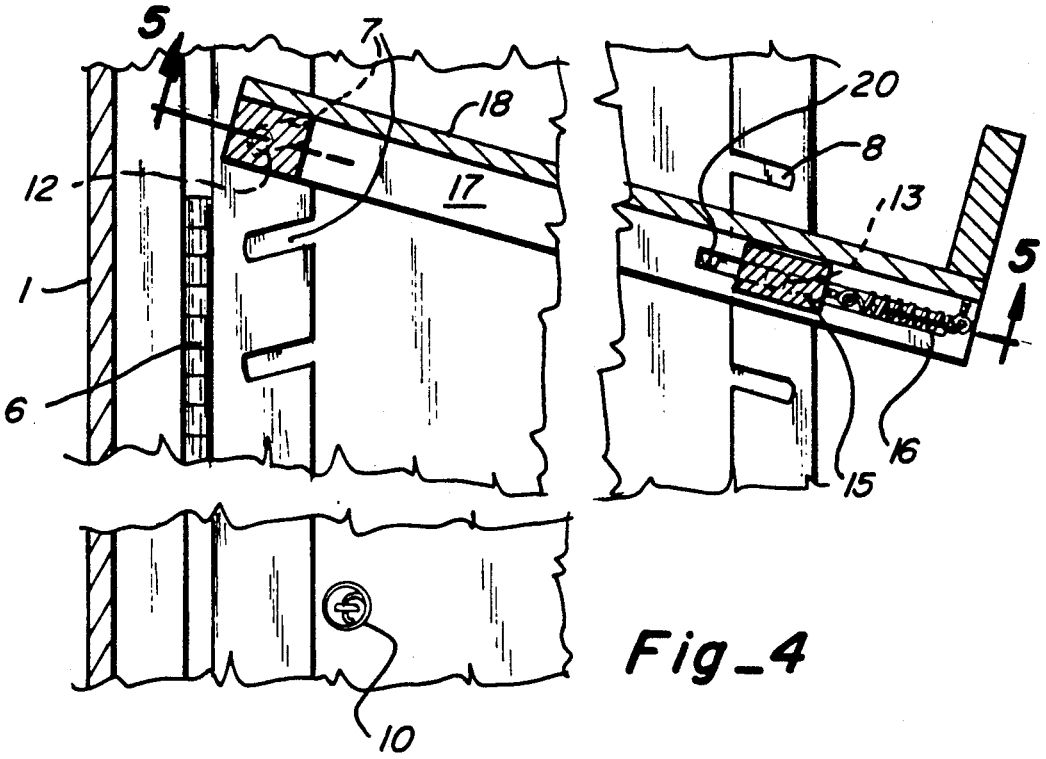
FIG. 4 is an enlarged cross-sectional view showing the support tray of FIG. 2 in detail.
Figure 5:
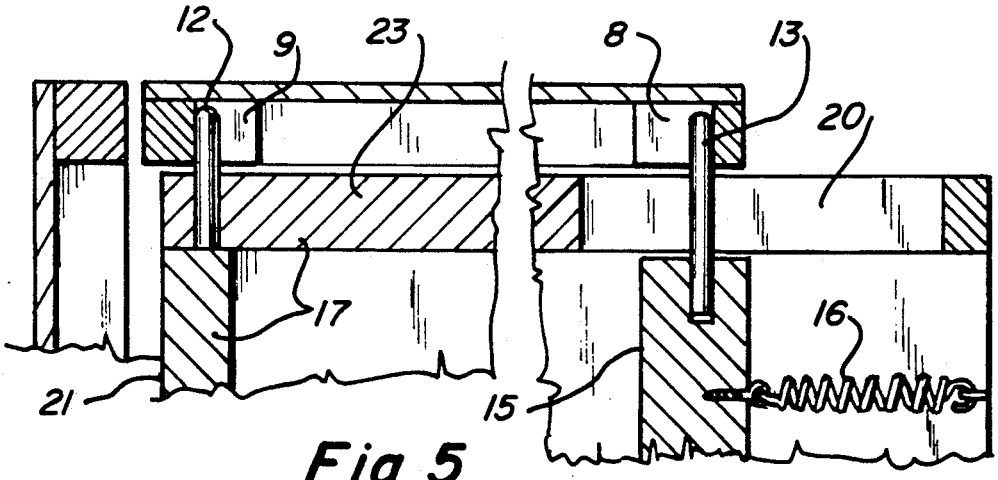
FIG. 5 is a cross-sectional view of the bottom of the support tray taken along line 5—5 of FIG. 4.

FIGS. 4 and 5 show the attaching and releasing means for the reading material support member in detail. The attachment and release means will be generally described and illustrated with reference to only one side of the reading material support member and one side support. It is understood that a similar attachment and releasing mechanism is on the other side of the support member.

Top surface 18 of the reading material support is edged by dimensioned lumber framing 17 on its underside. Pin 12 is provided in the side 23 of the framing. Pin 12 (and pin 11 similarly mounted on the opposite side) is placed in selected slots 9 to achieve the desired height for the rear end 21 of the support member.

Pins 13 and 14 are mounted on movable bar 15. The bar is attached to the underside of the reading material support member by biasing springs 16 and 17 (not shown in FIG. 5). The side framing 23 is provided with a slot 20 defining an open track for the movable pin 13 attached to bar 15. A similar track is provided for pin 14. The tracks allow the distance between pins 12 and 13 and between pins 11 and 14 to vary to achieve different angle orientations for the reading support member. The adjusting feature of the reading material support stand will be described with reference to FIGS. 3-5. Initially, pin 12 (and opposite pin 11) will be inserted in slots 9 of the side supports. Slots 9 are selected based on the desired height of the reading support member. Then, bar 15 will be moved inward against the bias of springs 16 and 17 so that pin 13 (and opposite pin 14) will move in track 20 to fit into the openings of selected slots 8. The springs 16 and 17 bias the bar so as to hold pins 13 and 14 in their selected slots. To release pins 13 and 14, the bar is moved inward against the bias of the springs. The user of the stand can achieve this movement with one hand, thus the stand can even be adjusted by a musician during a performance or while holding an instrument. Once released from one pair of slots 8, the pins 12 and 13 can move in racks 20 to be reinserted in another selected slot 8 to change the angle of the reading support member with respect to the back support.

Figure 6:
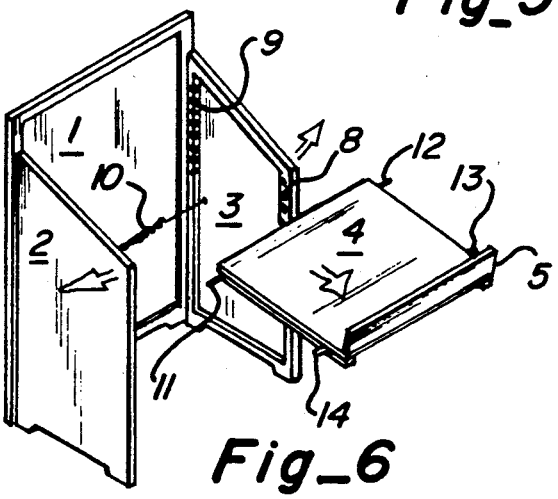
FIG. 6 is an exploded view showing the dismantling of the music stand.

The adjusting and release mechanism can also be used to quickly dismantle the stand. Bar 15 can be moved inward to release pins 13 and 14 from slots 8. Then pins 12 and 11 can be removed from slots 9. The reading material support member can then be removed or lifted away from the rest of the support as shown in FIG. 6.

Figure 7:
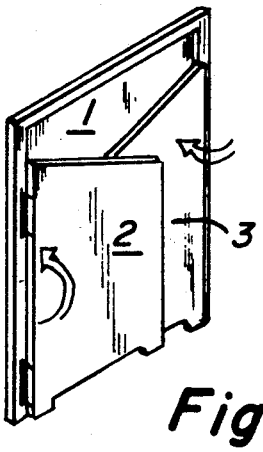
FIG. 7 is a view similar to FIG. 6 showing the main frame members in their folded condition.

Spring 10 biases side supports so that they will fold on each other about hinges 6 as shown in FIG. 7.

Similarly, to set up the stand, it is necessary to prop the side supports open against the bias of spring 10. Then, the support member 4 is inserted between the side supports 2 and 3. Pins 11 and 12 are initially placed in the desired slots 9. Bar 15 is moved so that pins 13 and 14 can fit in the selected slots 8.

As noted above, the stand can be used to support general reading material. It can be dimensioned so that a chair will fit under the support member 4. It can also accommodate a wheelchair if proportioned to do so. The stand can also be used as a music stand and its adjustment would be easy to achieve by a musician holding a musical instrument. If several stands are used by a stage band, the size of the back supports can be selected to give a uniform apperance to the audience. The stand can also be sized as a small collapsible lectern to be used by teachers or lecturers who must move from room to room. If smaller dimensions are chosen, the stand can also be adapted for use by a person confined to a bed.

We claim:

1. A stand for reading material comprising:

a back support, a first side support having a front and a back end, a second side support having a front and back end, means for securing said first and second side supports to said back support, a reading material support member arranged between said first and second side supports, said reading material support member having a rear end and a front end opposite said rear end, first means on said support member for attaching said rear end of said support member to said first and second side supports at a first location adjacent said back support, second means on said support member for attaching said reading material support member to said first and second side supports at a second location, means for varying the distance between said first means for attaching and said second means for attaching.

and biasing means for biasing said side supports toward each other.

2. A stand as in claim 1 comprising means for removing said support member and wherein said securing means comprises means for pivoting said first and second side supports with respect to said back support so that said first and second side supports can be collapsed on top of said back support when said support member is removed.

3. A stand as in claim 2 wherein said pivoting means comprises hinges.

4. A stand as in claim 1 wherein said reading material support member comprises a stop for reading material adjacent said front end.

5. A stand as in claim 1 wherein said first means for attaching comprises first and second pins on said support member, said stand comprising at least one slot on said first side support near said back end and at least, a second slot on said second side support near said back end, so that when said support member is attached to said side supports one of said pins will rest in each of said slots.

6. A stand as in claim 5 comprising a plurality of pairs of slots on said first and second side supports near said back end so that each of said pins will rest in a slot corresponding to the desired heights of said rear end of said support member.

7. A stand as in claim 5 wherein said means for varying the distance comprises means for releasing said second attaching means from said first and second side supports, means for pivoting said support member about said first and second pins to change the angle of said support member with respect to said back support reattaching and means for reattaching said second attaching means to said side supports.

8. A stand as in claim 1 wherein said biasing means comprises a spring.

9. A stand as in claim 1 wherein said biasing means comprises an elastic band.

10. A stand for reading material comprising:

a back support, a first side support having a front and back end, a second side support having a front and back end, means for securing said first and second side supports to said back support, a reading material support member arranged between said first and second side supports, said reading material support member having a rear end and a front end opposite said rear end, first means on said support member for attaching said rear end of said support member to said first and second side supports at a first location adjacent said back support, second means on said support member for attaching said reading material support member to said first and second side supports at a secnd location, means for varying the distance between said first means for attaching and said second means for attaching, said first means for attaching comprising first and second pins on said support member, said stand comprising at least one slot on said first side support near said back end, and at least a second slot on said second side support near said back end, so that when said support member is attached to said side supports one of said pins will rest in each of said slots, said means for varying the distance comprises means for releasing said second attaching means from said first and second side supports, means for pivoting said support member about said first and second pins to change the angle of said support member with respect to said back support and attaching means for reattaching said second attaching means to said side supports, said stand comprising a plurality of slots on said first side support near said front end, a plurality of slots on said second side support near said front end, said second attaching means comprising third and fourth pins on said support member for cooperating with selected pairs of said slots, said releasing means comprises a movable bar attached to said third and fourth pins, and a track for each said third and fourth pin on said support member, whereas movement of said bar moves said third and fourth pins in a first direction in said track and releases said third and fourth pins from said selected slots.

11. A stand as in claim 10 wherein said reattaching means comprises biasing means for moving said third and fourth pins in a second direction opposite said first direction for movement into another selected pair of said slots.

12. A stand as in claim 11 wherein said biasing means comprises spring means attached to said bar.

13. A stand as in claim 11 wherein said biasing means comprises elastic bands attached to said bar.

14. A stand as in claim 10 wherein said slots on said front end of said first and second side supports have openings which face the opening of said slots on said back end of said first and second side supports.

* * * * *